US006748681B1

(12) United States Patent
Dorney

(10) Patent No.: US 6,748,681 B1
(45) Date of Patent: Jun. 15, 2004

(54) ILLUMINATED BADGE SYSTEM

(76) Inventor: Peter Dorney, 950 S. Winter Park Dr., #101, Casselberry, FL (US) 32707

( * ) Notice: Subject to any disclaimer, the term of this patent is extended or adjusted under 35 U.S.C. 154(b) by 0 days.

(21) Appl. No.: 10/261,704

(22) Filed: Oct. 1, 2002

(51) Int. Cl.[7] ..... A44C 3/00
(52) U.S. Cl. ..... 40/1.5; 40/542; 40/124.02; 40/627; 40/594; 362/34
(58) Field of Search ..... 40/1.5, 542, 124.02, 40/627, 638, 594; 362/34

(56) References Cited

U.S. PATENT DOCUMENTS 5,557,869 A * 9/1996 Douglas ..... 40/542
5,755,506 A * 5/1998 Ray et al. ..... 40/1.5
5,809,678 A * 9/1998 Douglas ..... 362/34

* cited by examiner

*Primary Examiner*—Gary Hoge
(74) *Attorney, Agent, or Firm*—Edward P. Dutkiewicz

(57) ABSTRACT

An illuminated badge system has plastic top and bottom plates limited flexibility. The top plate has a front face and a side wall extending inwardly and with a lip extending radially outward from the wall. The bottom plate has a rectilinear rear face and a peripheral wall extending inwardly from the rear face with a lip extending radially from the peripheral wall thereby forming a recessed back portion whereby when the front plate and the bottom plate are coupled together a top chamber and a peripheral space with a dam portion are formed. Upon breaking of an ampule located within the top chamber, a first chemiluminescent liquid located within the peripheral space intermixes with a second chemiluminescent liquid located within the ampule and the intermixed liquids fill the peripheral space, excluding the dam portion.

4 Claims, 3 Drawing Sheets

FIG 1
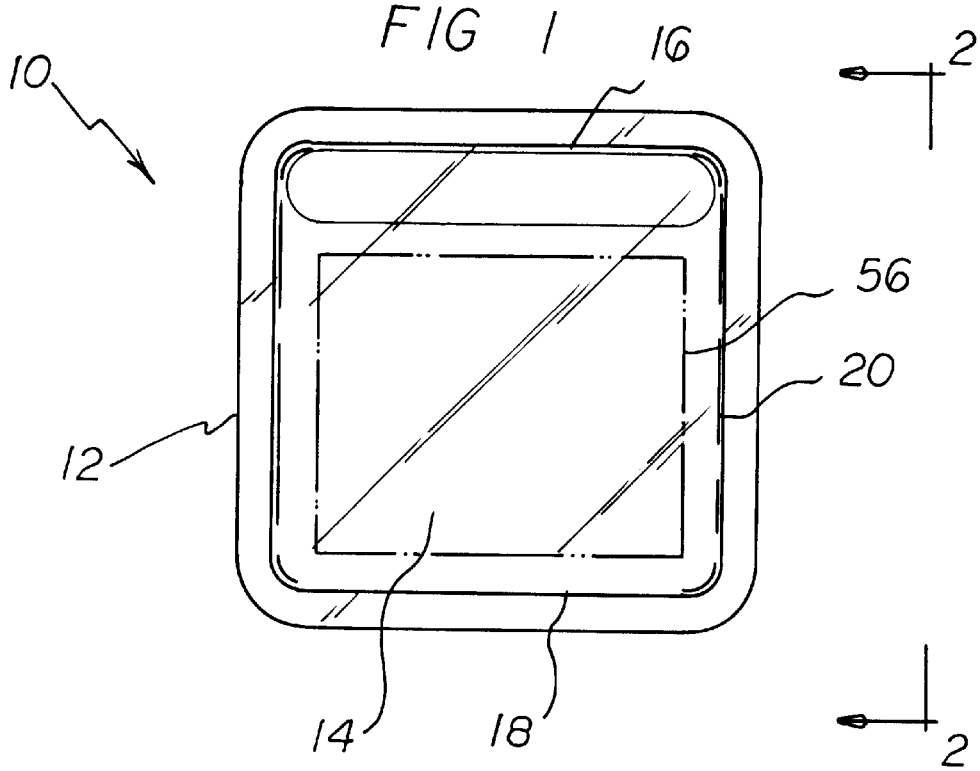
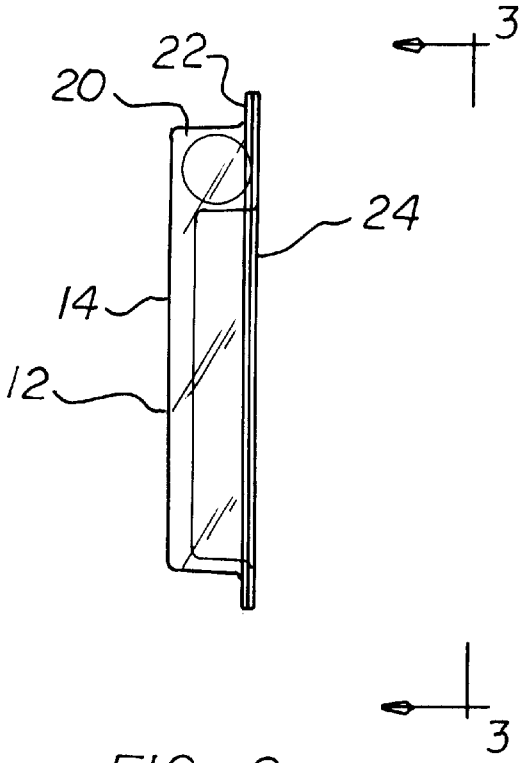
FIG 2

ILLUMINATED BADGE SYSTEM

BACKGROUND OF THE INVENTION

1. Field of the Invention

The present invention relates to an illuminated badge system and more particularly pertains to providing an illuminated badge having indicia.

2. Description of the Prior Art

The use of badges of known designs and configurations is known in the prior art. More specifically, badges of known designs and configurations previously devised and utilized for the purpose of illuminating indicia through conventional methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 4,814,949 issued Mar. 3, 1989 TO Elliott discloses a chemiluminescent device. Also, U.S. Pat. No. 5,557,869 issued Sep. 24, 1996 to Douglas discloses devices for alteration and display of chemiluminescent light.

While these devices fulfill their respective, particular objectives and requirements, the aforementioned patents do not describe an illuminated badge system that allows providing a glowing surface with indicia.

In this respect, the illuminated badge system according to the present invention substantially departs from the conventional concepts and designs of the prior art, and in doing so provides an apparatus primarily developed for the purpose of providing a glowing surface with indicia.

Therefore, it can be appreciated that there exists a continuing need for a new and improved illuminated badge system which can be used for providing a glowing surface with indicia. In this regard, the present invention substantially fulfills this need.

SUMMARY OF THE INVENTION

In view of the foregoing disadvantages inherent in the known types of badges of known designs and configurations now present in the prior art, the present invention provides an improved illuminated badge system. As such, the general purpose of the present invention, which will be described subsequently in greater detail, is to provide a new and improved illuminated badge system and method which has all the advantages of the prior art and none of the disadvantages.

To attain this, the present invention essentially comprises an illuminated badge system with indicia on a glowing surface. First provided is a top plate. The top plate has a generally rectangular configuration and is fabricated of a plastic material with limited flexibility. The top plate is formed with a front face. The front face has a top end and a bottom end. A side wall extends inwardly from the front face. A lip formed in the to plate extends radially outward from the side wall. Next provided is a bottom plate. The bottom plate has a generally rectangular configuration and is fabricated of a plastic material with limited flexibility. The bottom plate is formed with a rectilinear rear face. The rear face has four corners and a top side and a bottom side. A peripheral wall extends inwardly from the rear face. A lip extends radially from the peripheral wall. In this manner a recessed back portion is formed. The bottom plate has dimensions less than the top plate with the height of the rear face being less than the front face. When the front plate and the bottom plate are coupled together a top chamber and a peripheral space are formed. The peripheral space has a dam portion adjacent to the bottom side of the rear face such that no peripheral space is created. The coupling of the top plate and the bottom plate is facilitated with a wedge and groove system associated with the lips. Next provided is a first chemiluminescent liquid. The first chemiluminescent liquid is located within the peripheral space defined by the top plate and the bottom plate. A glass ampule is next provided. The glass ampule is located within the top chamber defined by the top plate and the bottom plate. A second chemiluminescent liquid is next provided. The second chemiluminescent material is located within the ampule. The second chemiluminescent material is adapted to intermix with the first chemiluminescent liquid and fill the peripheral space, excluding the dam portion, upon breaking of the glass ampule. Next provided is indicia. The indicia is in the front face of the top plate. A pair of thin cross straps are next provided. The cross straps are coupled to lip of the bottom plate. The cross straps cover the recessed back portion. Finally, a double sided adhesive is provided. The adhesive is coupled to the pair of cross straps.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved illuminated badge system which has all of the advantages of the prior art badges of known designs and configurations and none of the disadvantages.

It is another object of the present invention to provide a new and improved illuminated badge system which may be easily and efficiently manufactured and marketed.

It is further an object of the present invention to provide a new and improved illuminated badge system which is of durable and reliable constructions.

An even further object of the present invention is to provide a new and improved illuminated badge system which is susceptible of a low cost of manufacture with regard to both materials and labor, and which accordingly is then susceptible of low prices of sale to the consuming public, thereby making such illuminated badge system economically available to the buying public.

Even still another object of the present invention is to provide an illuminated badge system for providing indicia on a glowing surface.

Lastly, it is an object of the present invention to provide a new and improved illuminated badge system with plastic top and bottom plates of limited flexibility. The top plate has a front face and a side wall extending inwardly and with a lip extending radially outward from the wall. The bottom plate has a rectilinear rear face and a peripheral wall extending inwardly from the rear face with a lip extending radially from the peripheral wall thereby forming a recessed back portion whereby when the front plate and the bottom plate are coupled together a top chamber and a peripheral space with a dam portion are formed. Upon breaking of an ampule located within the top chamber, a first chemiluminescent liquid located within the peripheral space intermixes with a second chemiluminescent liquid located within the ampule and the intermixed liquids fill the peripheral space, excluding the dam portion.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a front elevational view of the illuminated badge system of the present invention.

FIG. 2 is a cross sectional view taken along line 2—2 of FIG. 1.

The same reference numerals refer to the same parts throughout the various Figures.

DESCRIPTION OF THE PREFERRED EMBODIMENT

Figure 3:
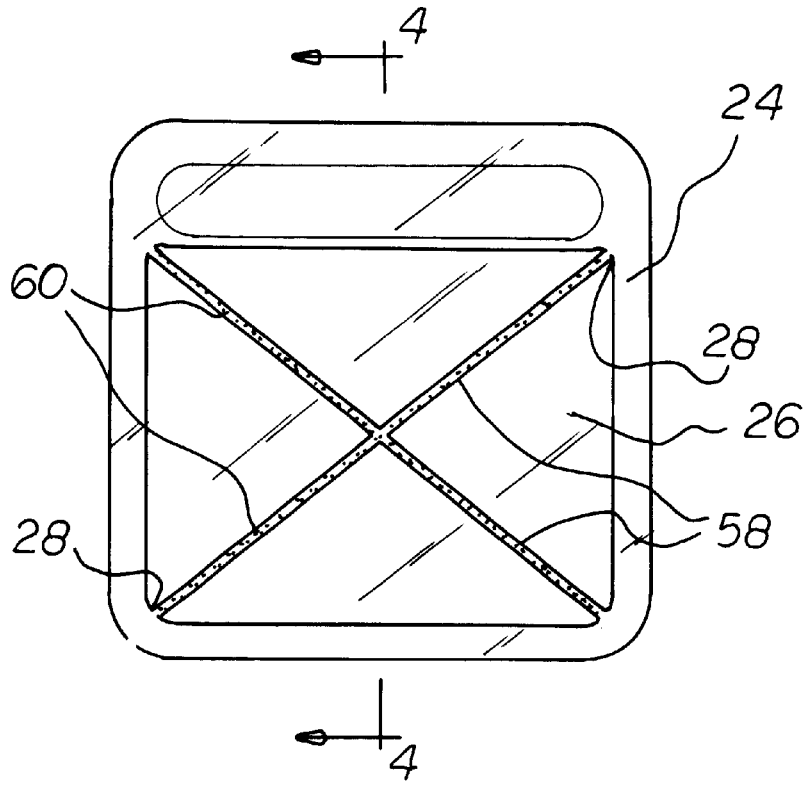
FIG. 3 is a rear elevational view of the system of the prior Figures.
Figure 4:
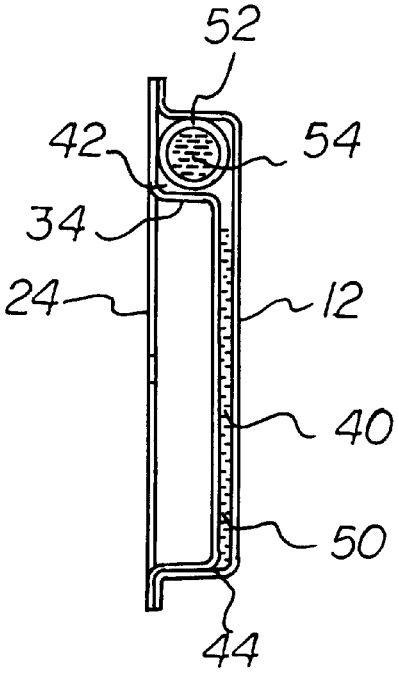
FIG. 4 is a cross sectional view taken along line 4—4 of FIG. 3.
Figure 5:
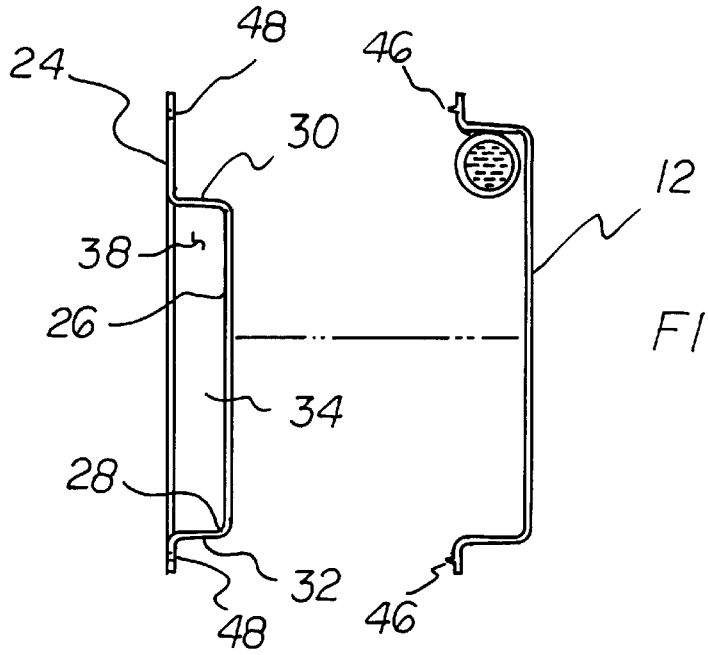
Figure 6:
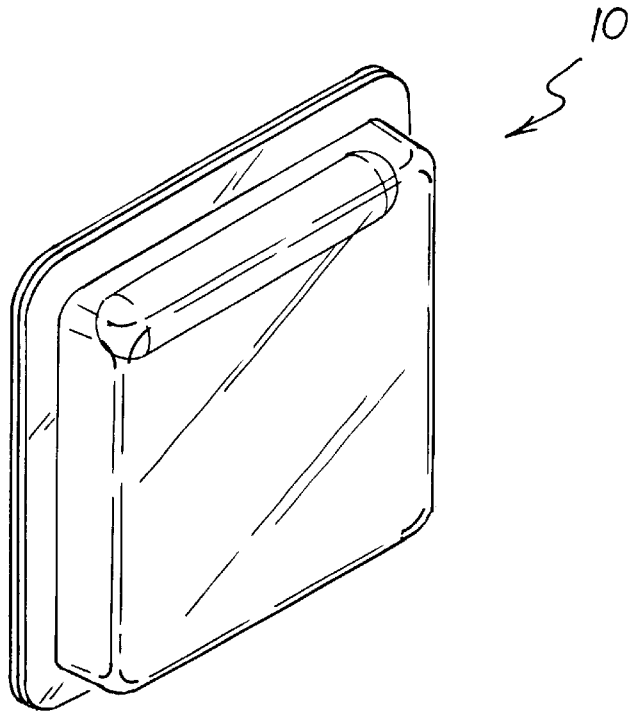

With reference now to the drawings, and in particular to FIG. 1 thereof, the preferred embodiment of the new and improved illuminated badge system embodying the principles and concepts of the present invention and generally designated by the reference numeral 10 will be described.

The present invention, the illuminated badge system 10 is comprised of a plurality of components. Such components in their broadest context include a top plate, a bottom plate, a first chemiluminescent liquid, an ampule, and a second chemiluminescent liquid. Such components are individually configured and correlated with respect to each other so as to attain the desired objective.

First provided is a top plate 12. The top plate has a generally rectangular configuration and is fabricated of a plastic material with limited flexibility. The top plate is formed with a front face 14. The front face has a top end 16 and a bottom end 18. A side wall 20 extends inwardly from the front face. A lip 22 formed in the plate extends radially outward from the side wall.

Next provided is a bottom plate 24. The bottom plate has a generally rectangular configuration and is fabricated of a plastic material with limited flexibility. The bottom plate is formed with a rectilinear rear face 26. The rear face has four corners 28 and a top side 30 and a bottom side 32. A peripheral wall 34 extends inwardly from the rear face. A lip 36 extends radially from the peripheral wall. In this manner a recessed back portion 38 is formed. The bottom plate has dimensions less than the top plate with the height of the rear face being less than the front face. When the front plate and the bottom plate are coupled together a top chamber 40 and a peripheral space 42 are formed. The peripheral space has a dam portion 44 adjacent to the bottom side of the rear face such that no peripheral space is created. The coupling of the top plate and the bottom plate is facilitated with a wedge 46 and groove system 48 associated with the lips.

Next provided is a first chemiluminescent liquid 50. The first chemiluminescent liquid is located within the peripheral space defined by the top plate and the bottom plate.

A glass ampule 52 is next provided. The glass ampule is located within the top chamber defined by the top plate and the bottom plate.

A second chemiluminescent liquid 54 is next provided. The second chemiluminescent material is located within the ampule. The second chemiluminescent material is adapted to intermix with the first chemiluminescent liquid and fill the peripheral space, excluding the dam portion, upon breaking of the glass ampule.

Next provided is indicia 56. The indicia is in the front face of the top plate.

A pair of thin cross straps 58 are next provided. The cross straps are coupled to lip of the bottom plate. The cross straps cover the recessed back portion.

Finally, a double sided adhesive 60 is provided. The adhesive is coupled to the pair of cross straps.

Upon breaking of the ampule located within the top chamber, the first chemiluminescent liquid located within the peripheral space intermixes with the second chemiluminescent liquid located within the ampule and the intermixed liquids fill the peripheral space, excluding the dam portion. In this manner, when the chemiluminescent liquids are intermixed, the badge glows, and the indicia becomes easily viewable.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An illuminated badge system with indicia on a glowing surface comprising, in combination:

a top plate having a generally rectangular configuration fabricated of a plastic material with limited flexibility and formed with a front face having a top end and a bottom end and a side wall extending inwardly from the front face, and also formed with a lip extending radially outward from the wall;

a bottom plate having a generally rectangular configuration fabricated of a plastic material with limited flexibility and formed with a rectilinear rear face with four corners and a top side and a bottom side and a peripheral wall extending inwardly from the rear face with a lip extending radially from the peripheral wall thereby forming a recessed back portion, the bottom plate having dimensions less than the top plate with the height of the rear face being less than the front face whereby when the front plate and the bottom plate are coupled together a top chamber and a peripheral space are formed, the peripheral space having a dam portion adjacent to the bottom side of the rear face such that no peripheral space is created, the coupling of the top plate and the bottom plate being facilitate with a wedge and groove system associated with the lips;

a first chemiluminescent liquid located within the peripheral space defined by the top plate and the bottom plate;

a glass ampule located within the top chamber defined by the top plate and the bottom plate;

a second chemiluminescent liquid located within the ampule and being adapted to inter mix with the first chemiluminescent liquid and fill the peripheral space excluding the dam portion upon breaking of the glass ampule;

indicia in the front face of the top plate;

a pair of thin cross straps coupled to lip of the bottom plate and covering the recessed back portion; and a double sided adhesive coupled to the pair of cross straps.

2. An illuminated badge system comprising:

a top plate fabricated of a plastic material with limited flexibility and formed with a front face and a side wall extending inwardly and also formed with a lip extending radially outward from the wall;

a bottom plate fabricated of a plastic material with limited flexibility and formed with a rectilinear rear face and a peripheral wall extending inwardly from the rear face with a lip extending radially from the peripheral wall thereby forming a recessed back portion whereby when the front plate and the bottom plate are coupled together a top chamber and a peripheral space are formed, the peripheral space having a dam portion;

a first chemiluminescent liquid located within the peripheral space;

an ampule located within the top chamber;

a second chemiluminescent liquid located within the ampule and being adapted to intermix with the first chemiluminescent liquid and fill the peripheral space excluding the dam portion upon breaking of the ampule.

3. The system as set forth in claim 2 and further including indicia on the front face of the top plate.

4. The system as set forth in claim 2 and further including a pair of thin cross straps coupled to the lip of the bottom plate and covering the recessed back portion and a double sided adhesive coupled to the pair of cross straps.

* * * * *